US011304869B2

(12) United States Patent
Freidenrich et al.

(10) Patent No.: US 11,304,869 B2
(45) Date of Patent: Apr. 19, 2022

(54) PORTABLE SYSTEM FOR THE PROPHYLAXIS OF DEEP VEIN THROMBOSIS

(71) Applicant: Bio Compression Systems, Inc., Moonachie, NJ (US)

(72) Inventors: Robert Freidenrich, New York, NY (US); Jonathan Ross, Westport, CT (US)

(73) Assignee: Bio Compression Systems, Inc., Moonachie, NJ (US)

( * ) Notice: Subject to any disclaimer, the term of this patent is extended or adjusted under 35 U.S.C. 154(b) by 0 days.

(21) Appl. No.: 16/785,945

(22) Filed: Feb. 10, 2020

(65) Prior Publication Data

US 2020/0253814 A1 Aug. 13, 2020

Related U.S. Application Data

(60) Provisional application No. 62/805,006, filed on Feb. 13, 2019.

(51) Int. Cl.
*A61H 9/00* (2006.01)

(52) U.S. Cl.
CPC ... *A61H 9/0092* (2013.01); *A61H 2201/0103* (2013.01); *A61H 2201/0157* (2013.01); *A61H 2205/106* (2013.01); *A61H 2209/00* (2013.01)

(58) Field of Classification Search
CPC ..... A61H 9/0092; A61H 9/0078
See application file for complete search history.

(56) References Cited

U.S. PATENT DOCUMENTS

| | | | | | |
|---|---|---|---|---|---|
| 5,263,473 | A * | 11/1993 | McWhorter | A61H 9/0078 | 601/151 |
| 5,951,502 | A * | 9/1999 | Peeler | A61H 9/0078 | 601/149 |
| 6,007,559 | A * | 12/1999 | Arkans | A61B 17/135 | 601/150 |
| 6,290,662 | B1 * | 9/2001 | Morris | A61H 9/0078 | 601/149 |
| 8,025,510 | B2 * | 9/2011 | Bolshakov | H01R 13/443 | 439/136 |
| 9,433,532 | B2 | 9/2016 | Vess | | |
| 10,092,250 | B2 * | 10/2018 | Tucker | A61B 5/7475 | |
| 10,278,482 | B1 * | 5/2019 | McElveen | A45F 3/005 | |
| 2002/0042583 | A1 * | 4/2002 | Barak | A61H 9/0078 | 601/1 |
| 2002/0091344 | A1 * | 7/2002 | Thomas | A61H 9/0078 | 601/148 |
| 2003/0006165 | A1 * | 1/2003 | Evans | B65D 5/0254 | 206/723 |

(Continued)

*Primary Examiner* — LaToya M Louis
(74) *Attorney, Agent, or Firm* — Locke Lord LLP; Scott D. Wofsy

(57) ABSTRACT

A kit is disclosed for facilitating the supply and return of a system for stimulating venous and arterial circulation in a patient to prevent deep vein thrombosis, which includes a left and right set of inflatable garment sleeves that are disposable, a pair a rechargeable battery powered pump assemblies for inflating the sleeves and that are reusable, a power supply adapter for recharging the pump assemblies and that is reusable, and a shipping carton for returning the pump assemblies and adapter to a supplier after the patient is ambulatory and the risks of deep vein thrombosis have ended.

10 Claims, 7 Drawing Sheets

(56) References Cited

U.S. PATENT DOCUMENTS

| | | | | |
|---|---|---|---|---|
| 2005/0143682 | A1* | 6/2005 | Cook | A61H 23/04 601/151 |
| 2006/0258964 | A1* | 11/2006 | Biondo | A61H 9/0078 601/152 |
| 2008/0262399 | A1* | 10/2008 | Kovelman | A61H 9/0078 601/152 |
| 2009/0000978 | A1* | 1/2009 | Li | B65D 5/5035 206/521 |
| 2011/0196269 | A1* | 8/2011 | Arkans | A61H 9/0092 601/15 |
| 2012/0089063 | A1* | 4/2012 | Olson | A61H 9/0078 601/152 |
| 2012/0247484 | A1* | 10/2012 | Jewell | A61G 7/057 128/845 |
| 2014/0276283 | A1* | 9/2014 | Mansur, Jr. | A61H 9/0078 601/150 |
| 2014/0303533 | A1* | 10/2014 | Zeutzius | A61H 9/0092 601/151 |
| 2017/0333281 | A1* | 11/2017 | Frank | A61H 9/0078 |
| 2019/0262219 | A1 | 8/2019 | Bennett | |
| 2020/0121545 | A1* | 4/2020 | Parker, Sr. | G16H 40/67 |

* cited by examiner

PORTABLE SYSTEM FOR THE PROPHYLAXIS OF DEEP VEIN THROMBOSIS

CROSS-REFERENCE TO RELATED APPLICATION

The subject application claims the benefit of priority to U.S. Provisional Patent Application Ser. No. 62/805,006, which was filed on Feb. 13, 2019, the disclosure of which is herein incorporated by reference in its entirety.

BACKGROUND OF THE INVENTION

1. Field of the Invention

The subject invention is directed to a device for stimulating venous and arterial circulation, and more particularly, to a portable system for the prophylaxis of deep vein thrombosis.

2. Description of Related Art

Deep Vein Thrombosis ("DVT") is a blood clot that can form in a vein in the lower leg or thigh. A DVT can become dislodged and travel through the bloodstream where it can enter the lung and block blood flow, creating a pulmonary embolism, which can cause damage to the lungs and other organs.

The most common causes of DVT are venous stasis, blood vessel wall injury, and hypercoagulability. Venous stasis is the reduction of blood flow, most notably in the areas of venous valves, usually caused by extended periods of inactivity. Hypercoagulability exists when coagulation outpaces fibrinolysis, which is the body's natural mechanism to inhibit clot formation.

In a patient with DVT, the goals are to minimize the risk of a pulmonary embolism, limit further clots, and facilitate the resolution of existing clots. If a potential clot is suspected or detected, bed rest is usually recommended to allow the clot to stabilize and adhere to the vein wall, thereby minimizing the chance of the clot becoming mobile.

Compression stockings have been used to apply pressure to the veins so as to reduce or minimize areas of low blood flow, while preventing the collection and coagulation of blood in these areas. Another accepted treatment method of DVT is intermittent pneumatic compression, which involves the use of an air pump to inflate and deflate sleeves wrapped around a patient's legs. The successive inflation and deflation of these sleeves simulates a series of compressions applied to the veins from muscle contractions, thereby limiting any stasis that can lead to clot formation.

Most portable intermittent pneumatic compression systems for treating DVT are completely discarded after use. However, since the air pump is an electromechanical device that typically contains rechargeable batteries, printed circuit boards and other electronic components, they can be detrimental to the environment when discarded.

For this reason it would be beneficial to provide a portable DVT treatment system that is reusable, and can be returned to a supplier after the patient is ambulatory and the risks of deep vein thrombosis have ended. The subject invention provides such a solution, which is described in detail below.

SUMMARY OF THE DISCLOSURE

The subject invention is directed to a new and useful system for stimulating venous and arterial circulation in a patient, and more particularly, to a portable system for the prophylaxis of deep vein thrombosis to aid in the prevention of venous static ulcers, aiding in the healing of cutaneous ulcers, and reducing acute/chronic edema and compartmental pressures.

The system includes a set of inflatable garment sleeves. These include a first garment sleeve configured to be wrapped around the left calf of a patient and a second garment sleeve configured to be wrapped around the right calf of the patient. Each garment sleeve has a compartmented air chamber embossed or formed in an interior surface thereof. The air chamber communicates with a rotatable air input tube located on an exterior surface of the sleeve.

The system further includes a set of portable pump assemblies for pressurizing the air chambers of the garment sleeves. These includes a first portable pump assembly adapted to be detachably secured to the exterior surface of the first or left garment sleeve and a second portable pump assembly adapted to be detachably secured to the exterior surface of the second or right garment sleeve. Each pump assembly includes a valve stem configured to detachably engage with the air input tube on the exterior surface of a respective garment sleeve.

Preferably, the interior surface of each garment sleeve is fabricated from a non-woven polyester material, the exterior surface of each garment sleeve is fabricated from a Nylex fabric, and a plurality of hook type fasteners are provided on an interior surface portion of each garment sleeve for detachably engaging the exterior surface of the garment sleeve.

Preferably, each portable pump assembly has a housing that encloses a rechargeable battery, and an alarm feature is provide to indicate a low battery power condition. The housing further encloses a pump, which is acoustically isolated with an acoustic foam material within the housing, and a control valve is positioned between the pump and the valve stem.

Each portable pump assembly also has a processor programmed to command the pump to inflate the air chamber in a respective garment sleeve to a preset pressure and the air chamber will deflate after a period of time. Preferably, the processor in each portable pump assembly is programmed to command the pump to inflate the air chamber in a respective garment sleeve to a pressure of 50 mm Hg+/−10 mm Hg and hold that pressure for a period of approximately 15 seconds, whereupon the control valve will open to allow the air chamber to deflate and be without pressure for a dwell period of approximately 45 seconds.

Each portable pump assembly has an alarm feature to indicate a low inflation pressure condition, and an electronic compliance meter that stores and audibly reports information regarding a length of time that the pump assembly was in use. Each portable pump assembly also includes an electronic pressure sensing circuit that monitors pressure with the air chamber of a garment sleeve and controls operation of the pump based thereupon.

The housing of each portable pump assembly has one or more hook type fastener pads on a rear surface thereof for detachably securing the pump assembly housing to the exterior surface of a garment sleeve. Preferably, the air input tube on the exterior surface of each garment sleeve is mounted for rotational positioning with respect to the valve stem of a portable pump assembly associated therewith. The air input tube on the exterior surface of each garment sleeve is configured as a right angled tubular connector, and it is mounted to a flange retained within the air chamber of the garment sleeve.

The system further comprises a dual corded power supply adapter for recharging the battery enclosed within the housing of each portable pump assembly, and the set of inflatable garment sleeves is intended to be disposable while the set of portable pump assemblies is intended to be reusable.

In this regard, the subject invention is also directed to a kit for facilitating the supply and return of a system for stimulating venous and arterial circulation in a patient to prevent deep vein thrombosis. The kit includes a left and right set of inflatable garment sleeves that are disposable, a pair a rechargeable battery powered pump assemblies for inflating the sleeves and that are reusable, a power supply adapter for recharging the pump assemblies and that is reusable, and a shipping carton for returning the pump assemblies and adapter to a supplier after the patient is ambulatory and the risks of deep vein thrombosis have ended.

The kit further includes a tray for packaging the pump assemblies and power supply adapter in the carton, and a supply carton for initially delivering to the patient the set of garment sleeves and the shipping carton enclosing the tray containing the pump assemblies and the power supply adapter, together with a user manual.

The subject invention is also specifically directed to a portable pump assembly for inflating a garment sleeve worn by a patient to prevent deep vein thrombosis, which includes a programmable microcontroller, a solenoid valve communicating with the microcontroller, and a pump communicating with the microcontroller, wherein the microcontroller is programmed to command the pump to inflate the garment sleeve to a preset pressure and hold that pressure for a first predetermined period of time, after which the microcontroller will command the valve to open and allow the garment sleeve to deflate and be without pressure for a second predetermined period of time. Preferably, the preset pressure is a pressure of 50 mm Hg+/−10 mm Hg, the first predetermined period of time is approximately 15 seconds, and the second predetermined period of time is approximately 45 seconds.

The portable pump assembly further includes a pressure sensor communicating with the microcontroller for measuring pressure conditions within the garment sleeve. The microcontroller is adapted and configured to command the pump to deliver air to the garment sleeve in the event that the pressure sensor detects a low pressure condition during the first predetermined period of time. The microcontroller is also adapted and configured to command the valve to open and relieve pressure in the garment sleeve in the event that the pressure sensor detects a high pressure condition during the first predetermined period of time.

These and other features of the system for stimulating venous and arterial circulation in a patient to prevent deep vein thrombosis and the kit for facilitating the supply and return of that system will become more readily apparent to those having ordinary skill in the art to which the subject invention appertains from the detailed description of the preferred embodiments taken in conjunction with the following brief description of the drawings.

BRIEF DESCRIPTION OF THE DRAWINGS

So that those having ordinary skill in the art will readily understand how to make and use the system and kit of the subject invention without undue experimentation, preferred embodiments thereof will be described in detail herein below with reference to the figures wherein.

DETAILED DESCRIPTION OF THE PREFERRED EMBODIMENTS

Figure 1:
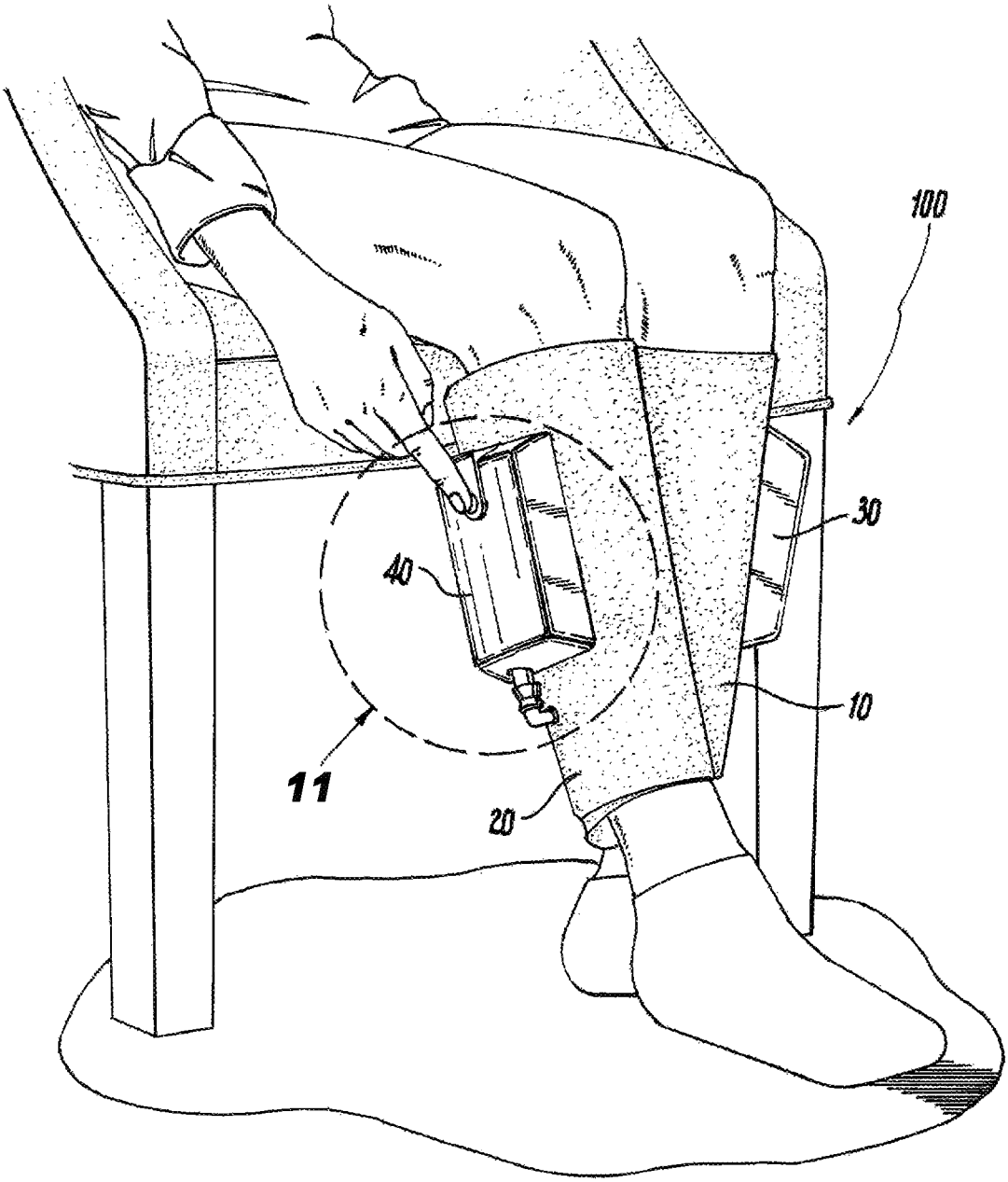
FIG. 1 is an illustration of the portable system of the subject invention deployed for use on the legs of a patient, which includes right and left fragment sleeves, each having a portable pump attached thereto.

Referring now to the drawings wherein like reference numerals identify similar structural features or elements of the subject invention, there is illustrated in FIG. 1 a new and useful system designated generally by reference numeral 100 for stimulating venous and arterial circulation in a patient to prevent deep vein thrombosis (DVT) and a kit for facilitating the supply and return of the system to a supplier after the patient is ambulatory and the risks of deep vein thrombosis have ended. The system is intended for non-ambulatory patients both in the hospital setting and at home.

Referring now to FIG. 1, the system 100 includes a first garment sleeve 10 that is adapted and configured to be wrapped around the left calf of the patient, and a second garment sleeve 20 that is adapted and configured to be wrapped around the right calf of a patient. A portable electromechanical pump assembly 30 is detachably secured to the first garment sleeve 10 and a second portable electromechanical pump assembly 40 is detachably secured to the second garment sleeve 20.

Figure 2:
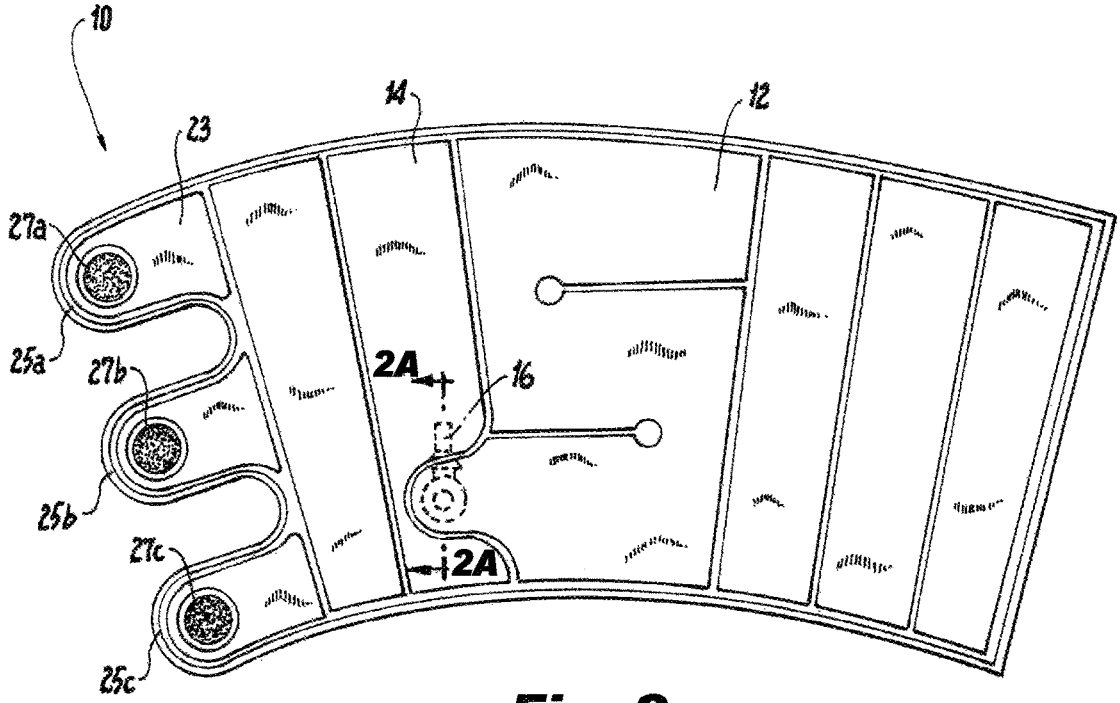
FIG. 2 is a top plan view of the interior surface of the left garment sleeve shown in FIG. 1, in a flat unwrapped condition.
Figure 2A:
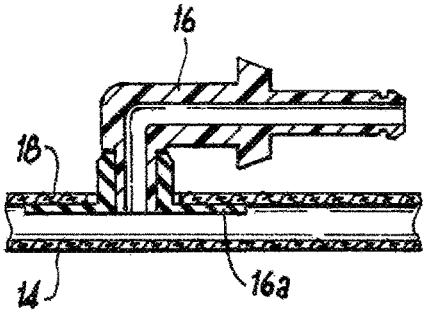
FIG. 2A is an enlarged cross-sectional elevational view of the air input tube of the left garment sleeve taken along line 2A-2A of FIG. 2.
Figure 3:
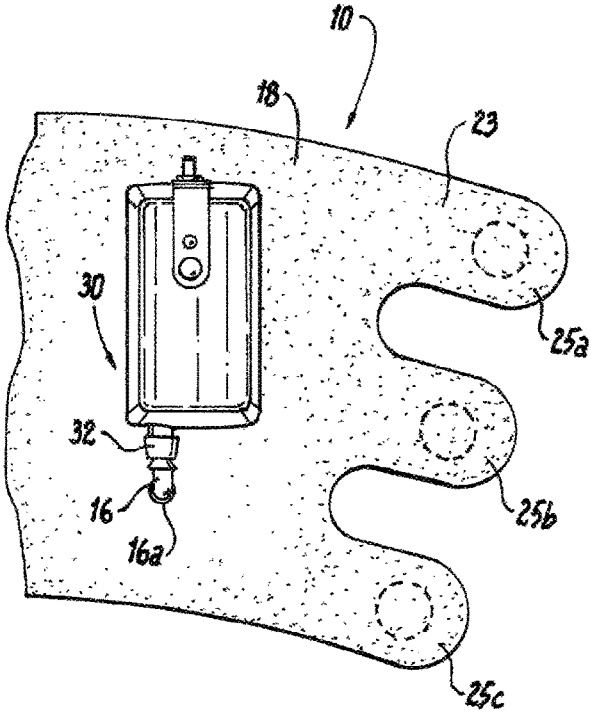
FIG. 3 is a bottom plan view of a portion of the exterior surface of the left garment sleeve shown in FIG. 2, with a portable pump assembly attached thereto.

Referring to FIGS. 2 and 3, the first garment sleeve 10 has a compartmented air chamber 12 embossed or otherwise formed in an interior surface 14 thereof. Air chamber 12 communicates with an air input tube 16 that is located on an exterior surface 18 of the garment sleeve 10 (see FIG. 2A). Garment sleeve 10 further includes an interior surface portion 23 that has three spaced apart fingers 25*a*-25*c*, each of which includes a respective hook type fastener pad 27*a*-27*c* for detachably engaging the exterior surface 18 of the garment sleeve 10 when it is wrapped around the left calf of the patient, as illustrated in FIG. 1.

The first portable pump assembly 30 is adapted to be detachably secured to the exterior surface 18 of the first garment sleeve 10 and it includes a valve stem 32 configured to detachably engage with the air input tube 16 on the exterior surface 18 of the first garment sleeve 10 for pressurizing the air chamber 12 of the first garment sleeve 10.

Figure 4:
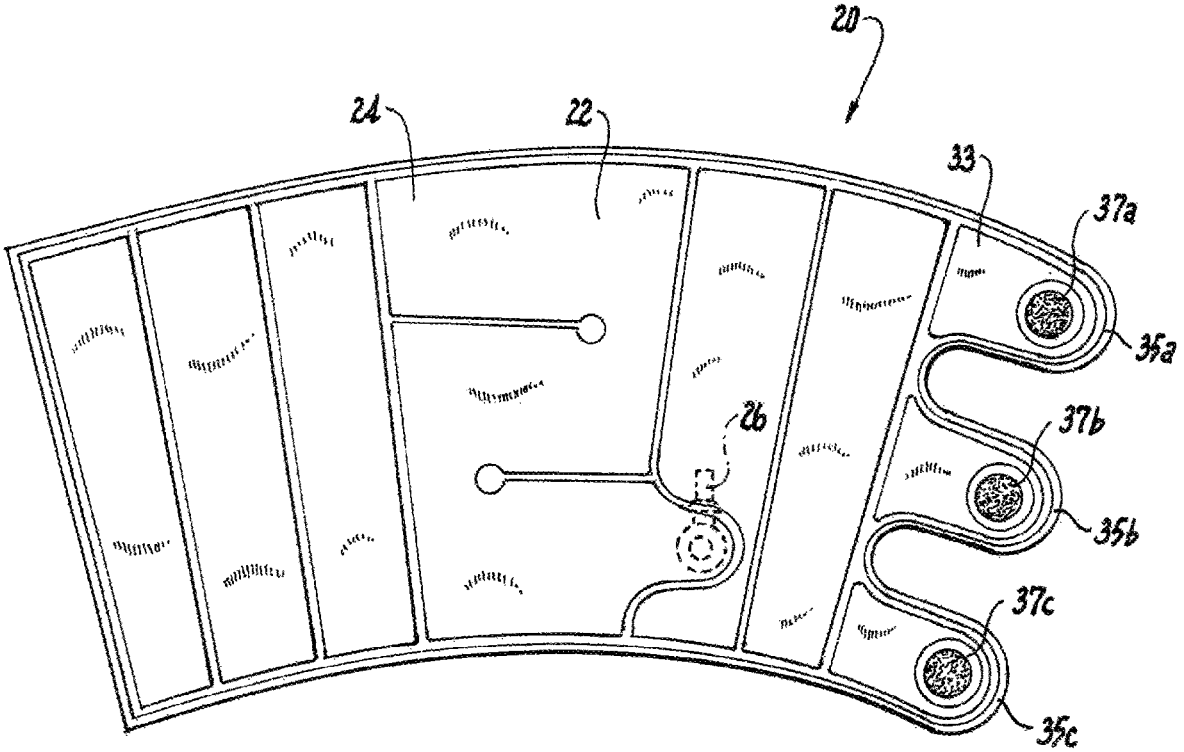
FIG. 4 is a top plan view of the interior surface of the right garment sleeve shown in FIG. 1, in a flat unwrapped condition.
Figure 5:
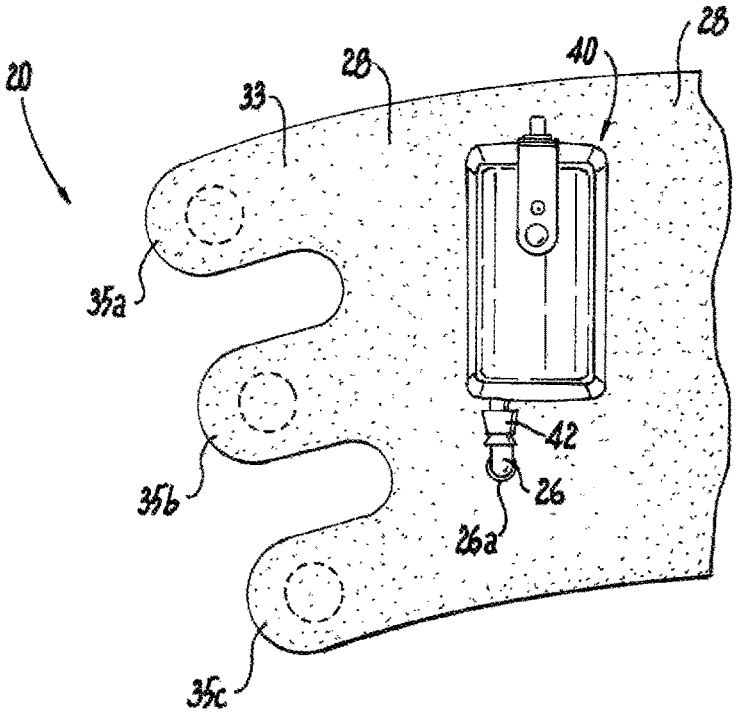
FIG. 5 is a bottom plan view of a portion of the exterior surface of the right garment sleeve shown in FIG. 4, with a portable pump assembly shown attached thereto.

Referring to FIGS. 4 and 5, the system further includes a second garment sleeve 20 that is adapted and configured to be wrapped around the right calf of the patient. Garment sleeve 20 has a compartmented air chamber 22 embossed or otherwise formed in an interior surface 24 thereof. Air chamber 22 which communicates with an air input tube 26 that is located on an exterior surface 28 of the garment sleeve 20.

Garment sleeve 20 further includes an interior surface portion 33 that has three spaced apart fingers 35*a*-35*c*, each of which includes a respective hook type fastener pad 37*a*-37*c* for detachably engaging the exterior surface 18 of the garment sleeve 10 when it is wrapped around the right calf of the patient, as illustrated in FIG. 1.

The second portable pump assembly 40 is adapted to be detachably secured to the exterior surface 28 of the second garment sleeve 20 and it includes a valve stem 42 configured to detachably engage the right-angled air input tube 26 on the exterior surface 28 of the second garment sleeve 20 for pressurizing the air chamber 22 in the second garment sleeve 20.

Preferably, the interior surface 14, 24 of each garment sleeve 10, 20 is fabricated from a non-woven polyester material, the exterior surface 18, 28 of each garment sleeve 10, 20 is fabricated from a Nylex fabric, and a plurality of hook type fasteners are provided on an interior surface portion of each garment sleeve for detachably engaging the exterior surface of the garment sleeve. The garment sleeves are designed for one-size fits all use. They are washable and disposable.

Figure 6:
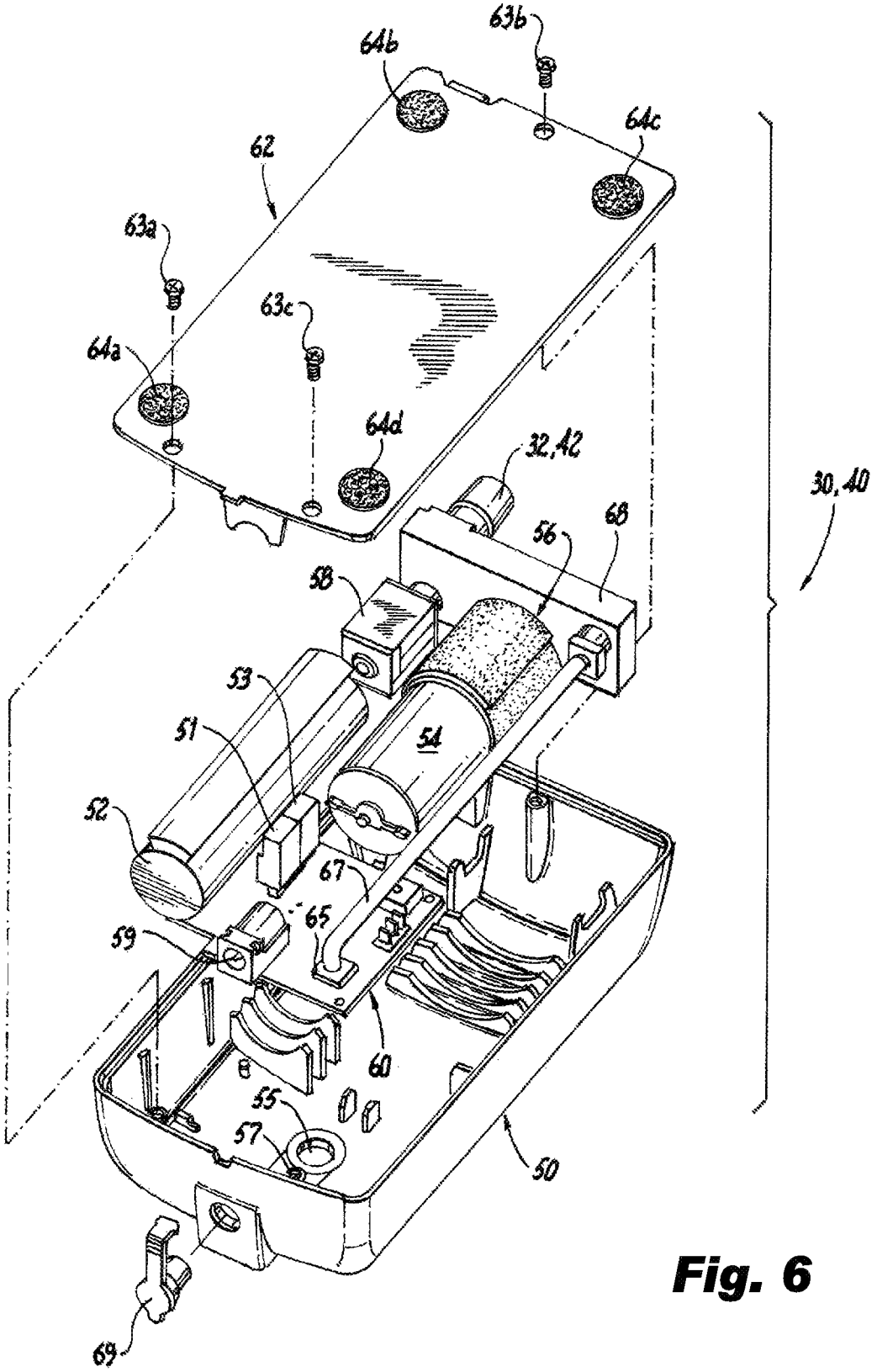
FIG. 6 is an exploded perspective view of one of the portable pump assemblies of the subject invention with its parts separated for ease of illustration.

Referring now to FIG. 6, each portable pump assembly 30, 40 has a generally rectangular housing 50 defining an interior cavity that encloses a rechargeable battery 52 (e.g., a lithium ion battery) that supplies over 20 hours of treatment on a single charge, ensuring patients can be transported easily from the hospital to their homes. Battery charging is conducted through a charging port 59, which has an associated plug 69 attached to the housing 50 by a tether for sealing the charging port 59 when it is not in use.

Each pump assembly 30, 40 includes an actuation button 55 for selectively turning the pump on and off. An LED indicator lamp 57 is connected to the actuation button 55 to provide information to the user. In addition, each pump assembly 30, 40 has an alarm feature to indicate a low battery power condition, and the system is designed to sound an alarm when the battery is at a critically low power state and shut down completely before battery damage occurs. The system is also designed to conserve battery power consumption.

The housing 50 further encloses a pump 54, which is acoustically isolated within the housing 50 by an acoustic foam material 56. The housing 50 also encloses a control valve 58, which extends between the pump 54 and the valve stem 32, 42. Valve 58 is in communication with the manifold 68, and it closes at the start of each inflation cycle, and after a predetermined time period (e.g., 15 seconds of hold time), the valve 58 opens to exhaust the air from the garment sleeves 10, 20. The valve 58 will also act as a safety feature in the vent that the pressure in the garment sleeves 10, 20 exceeds a preset limit. At such a time, the pump 54 will be commanded to shut off and the solenoid valve 58 will open to relieve the over-pressure condition.

Each portable pump assembly 30, 40 also has a processor circuit board 60 having a RISC-based microcontroller with ISP flash memory that is programmed to control battery usage and to command the pump 54 to inflate the air chamber 12, 22 in a respective garment sleeve 10, 20 to a preset pressure. The pump 54 will be commanded to shut off after the preset pressure is reached, and then after the predetermined period of hold time (e.g., 15 seconds) has ended, the solenoid valve 58 will be commanded to open and permit the air chamber 12, 22 to deflate.

A pressure sensor 65 is operatively associated with the circuit board 60 for measuring pressure within the air chamber and for maintaining that pressure within specified limits. The pressure sensor 65 communicates with the air chamber 12, 22 by way of a sensing tube 67 that communicates with the valve stem 32, 34 by way of a manifold 68. If the pressure in the air chamber 12, 22 decreases below a preset limit during the predetermined hold time period, the pump 54 will be commanded to deliver air into the air chamber 12, 22 to increase the pressure therein back up to the preset value for the remainder of the hold time period. The inflation of the sleeves 10, 20 exert pressure on the calf muscles, which is the motive force enhancing the return of venous blood from the lower extremity to the heart, thereby preventing stasis in non-ambulatory people.

The processor circuit board 60 in each portable pump assembly 30, 40 has a battery connector 51 that is electronically wired to the battery 52 and a pump connector 53 that is electronically wired to the pump 54. The microcontroller associated with the circuit board 60 is programmed to monitor battery state and command the functions of the pump 54. More particularly, the microcontroller is configured to command the pump 54 to inflate the air chamber 12, 22 in a respective garment sleeve 10, 20 to a pressure of 50 mm Hg+/−10 mm Hg and hold that pressure for approximately 15 seconds, after which the solenoid valve 58 will open to allow the air chamber 12, 22 to deflate and be without pressure for a dwell period of approximately 45 seconds.

The electronic pressure sensing capabilities of the system also includes a low pressure alert feature, whereby a visual and/or auditory alert is provided and treatment will be stopped if an air leak occurs or other low pressure condition arises and the specified pressure (e.g., 30 mmHg) is not reached. The electronic pressure sensing capabilities of the system further includes a high pressure alert feature which prevents excessive pressure (e.g., greater than 75 mm Hg) in the inflatable garment sleeves. As noted above, in the event of an excessive pressure condition, the solenoid valve 58 will open to relieve the pressure.

Each portable pump assembly 30, 40 includes a back cover plate 62 that is secured to the housing 50 by way of a plurality of threaded fasteners 63*a*-63*c*. The rear surface of the back cover plate 62 has a plurality of hook type fasteners disc 64*a*-64*d* for detachably securing the pump assembly housing 50 to the exterior surface 18, 28 of a garment sleeve 10, 20. Preferably, the air input tube 16, 26 on the exterior surface 18, 28 of each garment sleeve 10, 20 is mounted for rotational positioning with respect to the valve stem 32, 42 of a portable pump assembly 30, 40 associated therewith, to ease connectivity.

The air input tube 16, 26 on the exterior surface 18, 28 of each garment sleeve 10, 20 is configured as a right angled tubular connector, as best seen in section 2A-2A of FIG. 2, and it is mounted to a flange 16*a*, 26*a* retained within the air chamber 12, 22 of the garment sleeve 10, 20 (see FIGS. 3 and 5). The air inlet tube 16, 26 is mounted to swivel or rotate relative to the flange 16*a*, 26*a* for ease of connectivity and it provides the ability to connect the garment sleeve 10, 20 to a bed mounted pump (not shown).

As described and illustrated in further detail below, the system further comprises a power supply adapter for recharging the battery 52 enclosed within the housing 50 of each portable pump assembly 30, 40, and the garment sleeves 10, 20 are intended to be disposable while the portable pump assemblies 30, 40 are intended to be reusable. In this regard, the subject invention is also directed to a kit for facilitating the supply and return of the portable DVT treatment system described above.

Figure 7:
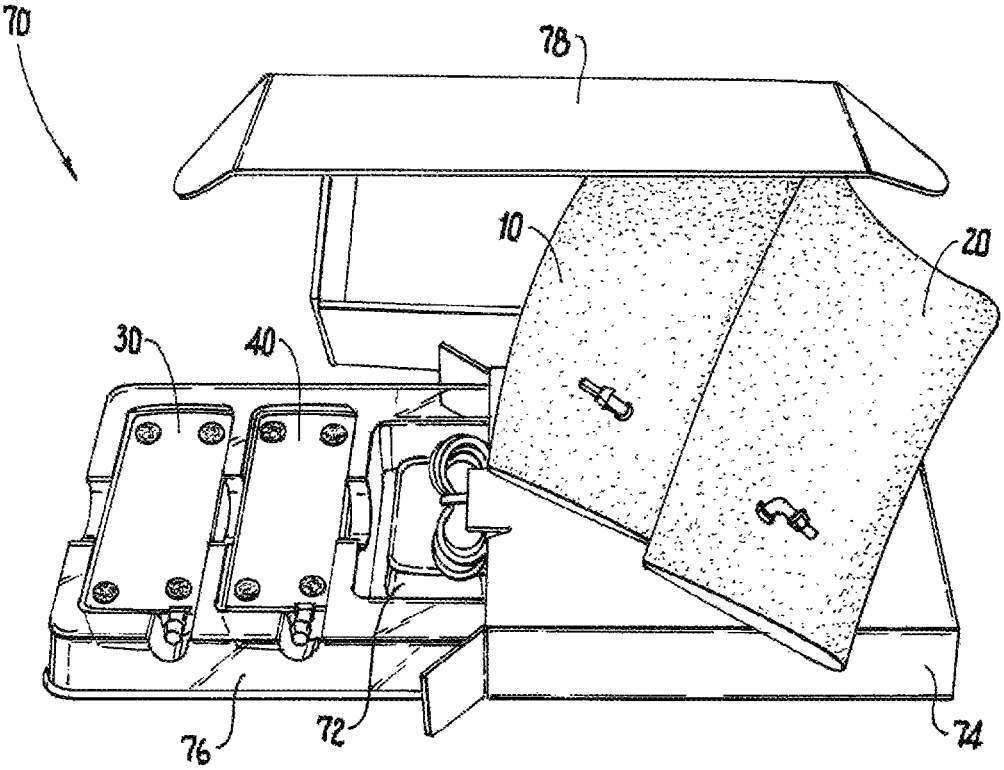
FIG. 7 is an illustration of the kit of the subject invention, which includes a supply carton for initial delivery to a patient, which encloses a set of garment sleeves, and a shipping carton enclosing a tray containing two rechargeable pump assemblies and a power supply adapter.

Referring now to FIG. 7, the kit 70 includes a left and right set of inflatable garment sleeves 10, 20 that are disposable, a pair a rechargeable battery powered pump assemblies 30, 40 for inflating the sleeves 10, 20 and that are reusable, a dual cord power supply adapter 72 for recharging the pump assemblies 30, 40 and that is reusable. The kit 70 also includes shipping carton 74 for returning the pump assemblies 30, 40 and the adapter 72 to a supplier after the patient is ambulatory and the risks of deep vein thrombosis have ended.

The kit 70 further includes a tray 76 for packaging the pump assemblies 30, 40 and power supply adapter 72 in the shipping carton 74, and a supply carton 78 for initially delivering to the patient the set of garment sleeves 10, 20 and the shipping carton 78 enclosing the tray 76 containing the pump assemblies 30, 40 and the power supply adapter 72, together with a user manual (not shown).

Figure 8:
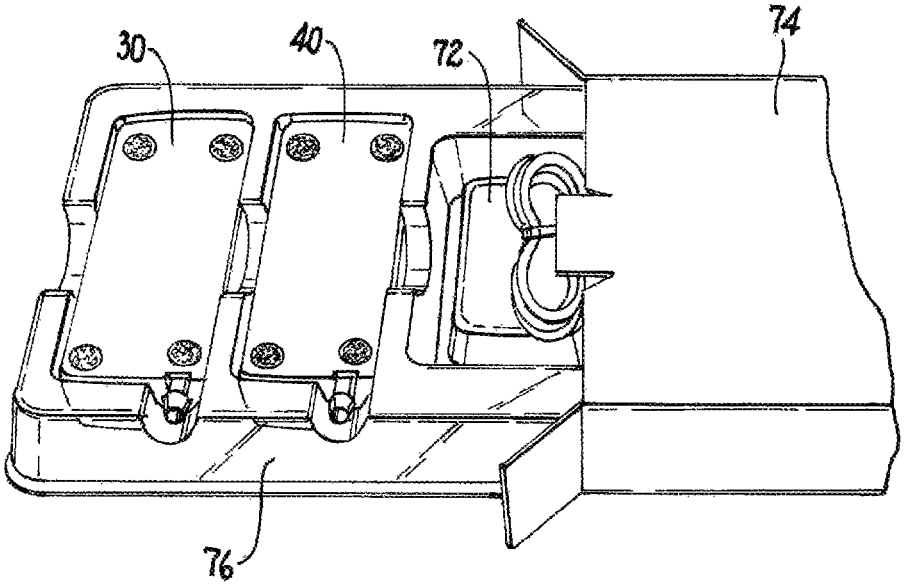
FIG. 8 is an illustration of the returnable components of the kit of the subject invention, which includes the shipping carton and the tray containing the two rechargeable pump assemblies and the power supply adapter.
Figure 9:
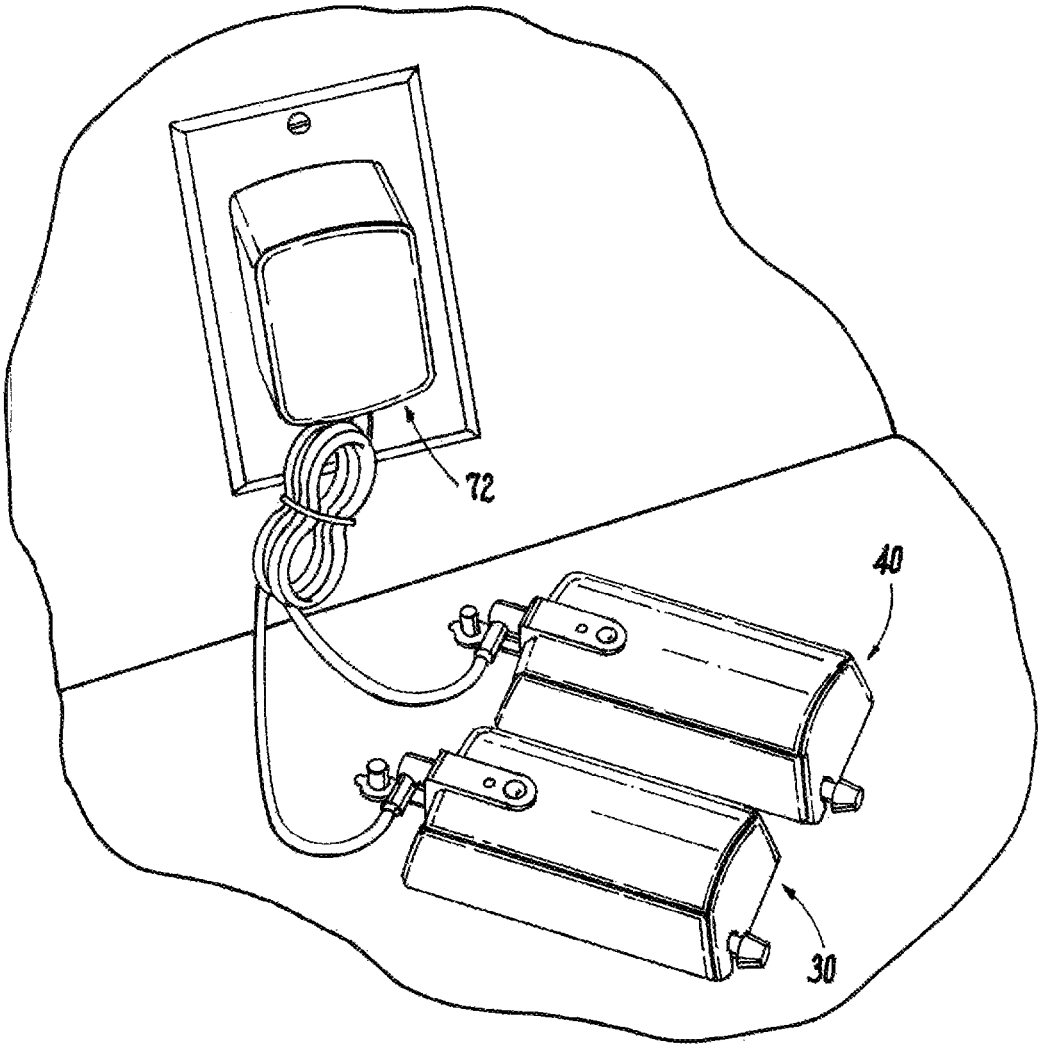
FIG. 9 is an illustration of two rechargeable pump assemblies connected to the dual corded power supply adapter which is plugged into an electrical outlet.
Figure 10:
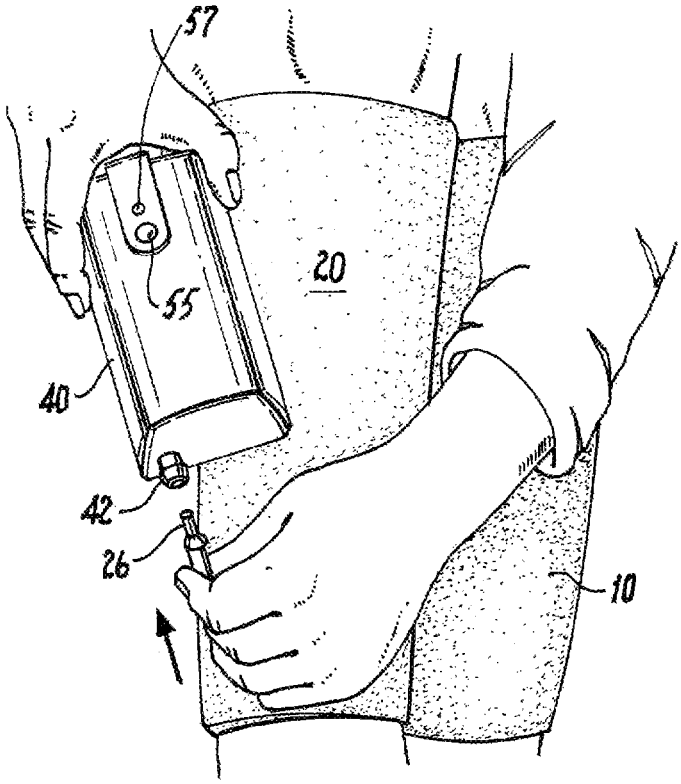
FIG. 10 is an illustration of a patient with a set of left and right inflatable garment sleeves wrapped around their calves, and depicting the patient connecting the valve stem of a portable pump assembly to the air inlet tube of the right garment sleeve.
Figure 11:
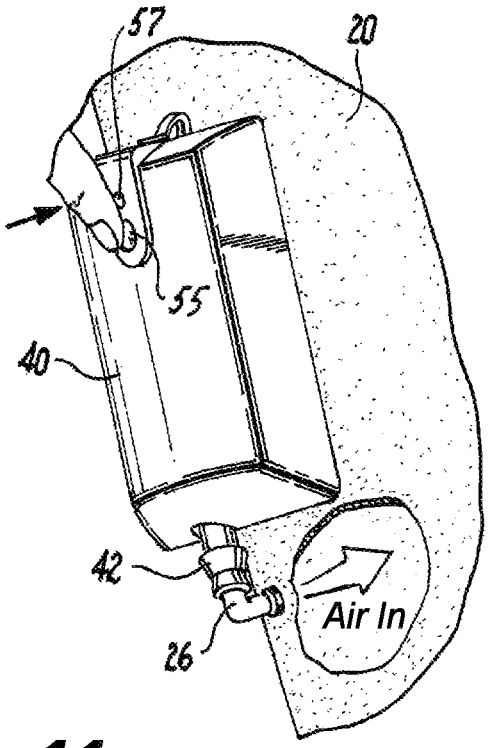
FIG. 11 is a localized illustration relating back to FIG. 1, showing the patient activating the portable pump assembly that is detachably secured to the exterior surface of the right inflatable garment sleeve.

Referring now to FIGS. 8 through 11, to use the DVT treatment system of the subject invention, the patient will open the kit 70, as shown in FIG. 8, remove the two pump assemblies 30, 40 from the tray 76, and connect them to the dual cord power supply adapter 72 for charging, as shown in FIG. 9. Thereafter, the patient will wrap the right and left garment sleeves 10, 20 around their lower legs, as shown in FIG. 10, and connect the valve stems 32, 42 of each pump assembly 30, 40 to the respective air input tube 16, 26 of the inflatable garment sleeves 10, 20. Then, each pump assembly 30, 40 is detachably connected to the exterior surface of the garment sleeve 10, 20 using the fasteners pads 64*a*-64*d* on the rear surface of the pump housing 50, as depicted in FIG. 11. At such a time, each pump assembly 20, 40 can be activated by depressing actuation button 55.

Each pump assembly 30, 40 of the DVT treatment system of the subject invention also includes an electronic compliance meter that stores and reports information on demand regarding a length of time that each pump assembly was in use. This allows the supplier to monitor and control its inventory of used pumps that have been returned in a reliable manner. The compliance meter is an audible reporting code that is incorporated into the processor circuit board 60 in each pump assembly 30, 40. The system is configured to store hours of usage for a significant period of time, such as, for example, up to 1000 hours.

To determine the length of time the pump assembly was used, the user presses and holds the power button on the pump assembly for 10 seconds until they hear an audible beeping signal. The power button is then released, at which time the user would hear a long beep followed by a series of short beeps. Each series of short beeps represents a numeric or ordinal place holder.

For example, if there is a long beep to indicate the start of the report, then 3 short beeps, a quick pause, followed by 5 short beeps, and then a long beep to indicate the end of the report, the user would determine that the pump assembly was used for 35 hours. The report can then be erased by pressing and holding the power button on the pump assembly for a longer period of time.

Each pump assembly 30, 40 of the DVT treatment system of the subject invention is also adapted and configured to electronically sense the pressure in the air chamber 12, 22 of the respective garment sleeve 10, 20 with which it is associated electronically, which in turn activates the internal pump 54 to bring the sleeve to a correct pressure. Then, the system will hold the sleeve pressure for the full preset time (i.e., 15 seconds) before relieving the pressure for a period of 45 seconds.

The electronic pressure sensing feature of the subject invention, which is provided by pressure sensor 65 on circuit board 60, differs from other products known in the art, which employ a spring loaded relief valve. In such devices, when the sleeve pressure reaches a preset limit, the relief valve opens to release the air in the sleeve bladder. Here, the pressure sensor 65 provides the control. Furthermore, the cycle time could be as short as 7-9 seconds, instead of a full 15 seconds, which is preferred. That is, the preferred cycle time for DVT prophylaxis devices is 15 seconds of pressure followed by 45 seconds of relief, which may be unmet by prior art devices with spring loaded relief valves.

While the DVT treatment system of the subject disclosure has been shown and described with reference to a preferred embodiment, those skilled in the art will readily appreciate that changes and/or modifications may be made thereto without departing from the scope of the subject disclosure.

What is claimed is:

1. A system for stimulating venous and arterial circulation in a patient to prevent deep vein thrombosis, comprising:

a) a first disposable garment sleeve configured to be wrapped around a left calf of the patient and having a compartmented air chamber formed in an interior surface thereof;

b) a second disposable garment sleeve configured to be wrapped around a right calf of the patient and having a compartmented air chamber formed in an interior surface thereof;

c) a first reusable pump assembly for pressurizing the air chamber in the first garment sleeve, wherein the first pump assembly includes a housing adapted to be detachably secured to an exterior surface of the first garment sleeve;

d) a second reusable pump assembly for pressurizing the air chamber in the second garment sleeve, wherein the second pump assembly includes a housing adapted to be detachably secured to an exterior surface of the second garment sleeve;

e) a dual cord power supply adapter for recharging a first rechargeable battery in the first pump assembly and a second rechargeable battery in the second pump assembly at the same time;

f) a tray having recesses for packaging the first and second pump assemblies and the dual cord power supply adapter together;

g) a shipping carton for enclosing the tray containing the first and second pump assemblies and the power supply adapter together and for returning the first and second pump assemblies and the power supply adapter to a supplier after the patient is ambulatory; and h) a supply carton for initially delivering the first and second garment sleeves and the shipping carton enclosing the tray containing the first and second pump assemblies and the power supply adapter to the patient, wherein each of the pump assemblies includes an electronic compliance meter associated with a processor that stores and reports information on demand regarding a length of time each one of the pump assemblies was in use to allow the supplier to monitor and control an inventory of used pump assemblies that have been returned, wherein the compliance meter in each one of the pump assemblies generates an audible reporting code that includes successive series of sounds, wherein each of the successive series of sounds represents a corresponding ordinal place holder, which taken together indicates a number of hours that each one of the pump assemblies was used, so that a first one of the series of sounds represents a first numeral and a second one of the series of sounds represents a second numeral.

2. A system as recited in claim 1, wherein the interior surface of each garment sleeve is fabricated from a non-woven polyester material.

3. A system as recited in claim 1, wherein the exterior surface of each one of the garment sleeves is fabricated from a nylex fabric.

4. A system as recited in claim 1, wherein each one of the pump assemblies has an alarm feature to indicate a low battery power condition.

5. A system as recited in claim 4, wherein each one of the pump assemblies has a means to shut down the system at a critically low battery power to avoid battery damage.

6. A system as recited in claim 1, wherein the processor in each one of the pump assemblies is programmed to command each one of the pump assemblies to inflate the air chamber in a respective garment sleeve to a preset pressure and the air chamber will deflate after a predetermined period of time.

7. A system as recited in claim 6, wherein the processor in each one of the pump assemblies is programmed to command each one of the pump assemblies to inflate the air chamber in a respective garment sleeve to a preset pressure of 50 mm Hg+/−10 mm Hg and hold that pressure for 15 seconds, whereupon the solenoid valve will open to allow the air chamber to deflate and be without pressure for 45 seconds.

8. A system as recited in claim 6, wherein each one of the pump assemblies has an alarm feature to indicate a low inflation pressure condition.

9. A system as recited in claim 6, wherein each one of the pump assemblies has an alarm feature to indicate a high inflation pressure condition.

10. A system for stimulating venous and arterial circulation in a patient to prevent deep vein thrombosis, comprising:

a) a first garment sleeve configured to be wrapped around a left calf of the patient and having an air chamber formed in an interior surface thereof;

b) a second garment sleeve configured to be wrapped around a right calf of the patient and having an air chamber formed in an interior surface thereof;

c) a first pump assembly for pressurizing the air chamber in the first garment sleeve; and d) a second pump assembly for pressurizing the air chamber in the second garment sleeve, wherein each pump assembly includes an electronic compliance meter associated with a processor that stores and reports information on demand regarding a length of time each one of the pump assemblies was in use, wherein the compliance meter in each one of the pump assemblies generates an audible reporting code that includes successive series of sounds, wherein each of the successive series of sounds represents a corresponding ordinal place holder, which taken together indicates a number of hours each one of the pump assemblies was used, wherein a first series of sounds represents a first numeral in the number of hours the pump assembly was used and a second series of sounds represents a second numeral in the number of hours the pump assembly was used.

* * * * *